US006495034B1

(12) United States Patent
Schmidtke et al.

(10) Patent No.: US 6,495,034 B1
(45) Date of Patent: Dec. 17, 2002

(54) SWIMMING POOL VALVE SYSTEM

(76) Inventors: Daniel Lee Schmidtke, deceased, late of Scottsdale, AZ (US); by Sharon Schmidtke, legal representative, 7662 E. Quill Ln., Scottsdale, AZ (US) 85255

( * ) Notice: Subject to any disclaimer, the term of this patent is extended or adjusted under 35 U.S.C. 154(b) by 1 day.

(21) Appl. No.: 09/863,668

(22) Filed: May 23, 2001

(51) Int. Cl.[7] ..... E04H 4/16; F16K 31/44

(52) U.S. Cl. ..... 210/169; 210/252; 210/259; 210/416.2; 210/418; 251/186; 251/324

(58) Field of Search ..... 210/169, 232, 210/252, 259, 416.1, 416.2, 418; 251/176, 182, 321, 324

(56) References Cited

U.S. PATENT DOCUMENTS 2,790,461 A * 4/1957 Lightfoot et al. ..... 4/490
3,247,968 A * 4/1966 Miller ..... 137/635
4,154,679 A 5/1979 Farage
4,206,522 A 6/1980 Baker
4,389,739 A 6/1983 Baker
4,643,217 A 2/1987 Frentzel
4,729,406 A 3/1988 Frentzel
5,581,826 A * 12/1996 Edwards ..... 4/507
6,448,453 B1 * 4/2000 King, Jr. ..... 137/111
6,056,873 A * 5/2000 Hartley et al. ..... 210/90

FOREIGN PATENT DOCUMENTS

DE 3447650 * 7/1985
DE 4019351 * 11/1991

* cited by examiner

*Primary Examiner*—David A. Simmons
*Assistant Examiner*—Fred Prince
(74) *Attorney, Agent, or Firm*—Parsons & Goltry; Michael W. Goltry; Robert A. Parsons

(57) ABSTRACT

A swimming pool installation including a skimmer device, a vacuum system, a pump and a valve module is disclosed. A seat divides the valve module into an upstream chamber coupled to the skimmer device and a downstream chamber coupled to the vacuum system and the pump. A piston having a seal is mounted in the upstream chamber for reciprocal movement in opposition to the seat and is biased away from the seat. A pawl is mounted to the piston for rotation and stops are mounted adjacent the pawl. The piston moves reciprocally in response to a cyclical application and removal of water movement there across caused by a cyclical operation of the pump, which causes the pawl to interact with the stops and cycle between a locked condition securing the seal away from the seat and an unlocked condition permitting the seal to move against the seat.

32 Claims, 14 Drawing Sheets

SWIMMING POOL VALVE SYSTEM

FIELD OF THE INVENTION

This invention relates to swimming pools.

More particularly, the present invention relates to a pool cleaning system including a skimmer device and a vacuum system.

In a further and more specific aspect, the present invention relates to a valve for alternating pool water movement between different cleaning devices of a pool cleaning system.

BACKGROUND OF THE INVENTION

A conventional swimming pool installation usually incorporates a recirculating system having a pump and a filter assembly located adjacent the pool for circulating and filtering the pool water. Typically included in this recirculating system is a skimming device adjacent the sidewall of the pool and, a main drain located on the floor of the pool. Water from the pool is drawn through the skimming device and the main drain by the pump, and forced through the filter assembly before being returned to the pool through a discharge outlet. The skimmer device removes the film of material and floating objects from the surface of the water while the main drain is adapted to collect sediment that sinks to the bottom of the pool. A small filter basket is usually provided in the system before the pump to intercept large debris picked up by the main drain or which has passed through the skimmer device.

Often, before the skimming device can remove all of the dirt and debris from the surface of the pool, the material will sink. The dirt and debris that sinks to the bottom of the pool collects on the floor and may not be pulled through the main drain. To remove this material, it must be swept toward the main drain, or vacuumed up as is commonly done. A vacuum generally consists of a hose having a first end coupled to a vacuum head and a second end coupled to the pump to provide suction. The second end is generally coupled to the pump via the skimmer device. Many skimmer devices are adapted to receive the second end of the hose directly, or by using an adapter. The material is sucked through the hose with the pool water, and forced through the filter assembly that removes the material.

Many pool owners find the necessity of vacuuming the pool a tedious task, best avoided at all costs. To this end, they hire services that maintain the pool or have installed special devices that will automatically clean the pool. These devices include special jets, which form water currents pushing dirt and debris toward the main drain and automatic vacuum devices. The automatic vacuum devices are similar to conventional vacuums, in that they include a vacuum head and a hose. The difference is that they continuously move about the pool floor by themselves, continually picking up dirt and debris. This greatly reduces the labor involved in keeping a pool clean. Automatic vacuums, however, present new problems.

In a properly maintained pool, the skimmer device will keep the surface of the pool clean, and remove large debris before it sinks. The skimmer device generally includes a strainer basket that collects the larger debris and prevents it from passing on to the filter assembly. The strainer basket can be easily emptied of the collected debris. In this manner, very little debris will pass through the system to the small strainer basket. This is desirable because as debris collects in the basket, the performance of the recirculating system is reduced. In a properly maintained system, the smaller basket needs to be cleaned infrequently. This is accomplished by turning the pump off, opening a scaled lid and removing the basket. The basket must then be replaced and the system resealed and started. During vacuuming, the strainer basket is removed from the skimmer device, and the second end of the hose is inserted into the skimmer device. The collected material goes directly to the filter assembly, with the small strainer basket in the line to remove any large debris. While this system works sufficiently well for its intended conventional use, problems occur when a continuous and automatic vacuum is employed.

In most pool cleaning systems, an automatic vacuum is generally coupled to the pump through the skimmer device, rendering the skimmer inoperative. In a particularly noteworthy pool cleaning system, the skimmer device and the automatic vacuum are constructed and arranged such that the swimming pool may be continuously vacuumed while the skimmer device and the main drain are also operating. With the vacuum and the skimmer device and the main drain operating simultaneously, tremendous and continuous strain is placed on the pump. As a result, a bigger pump usually must be employed, which significantly increases power consumption. Also, although simultaneous operation of the skimming device, main drain and vacuum can be desirable, it is typically unnecessary in providing a clean swimming pool.

Thus, there is a need for an improved pool cleaning system including a valve, which couples a skimmer device, a vacuum and a main drain of a pool installation to a pump, and that is responsive to sequential operation of the pump for moving between skimmer and main drain operation, and simultaneous operation of the skimmer, main drain and vacuum system. By toggling between these two modes of operation, a swimming pool is kept clean and the strain and wear and tear on the pump and the vacuum is significantly diminished.

SUMMARY OF THE INVENTION

Briefly, to achieve the desired objects of the instant invention in accordance with a preferred embodiment thereof, provided is valve system for use in a swimming pool installation including a swimming pool and a recirculating system having a skimmer device, a vacuum system and a pump. The pump is configured to cycle between inactive and active conditions. The valve system includes a housing defining a main chamber and a seat extending from the housing, which divides the main chamber into an upstream chamber which is coupled to the skimmer device and a downstream chamber which is coupled to the vacuum system and to the pump, and the coupling of the skimmer device and the vacuum system can be reversed. A piston having a seal is mounted in the upstream chamber for reciprocal movement in opposition to the seat. The seal opposes the seat and because the seal is part of the piston, reciprocal movement of the piston in reciprocal directions in opposition to the seat results in movement of the seal away from the seat and against the seat isolating the upstream chamber from the downstream chamber. A pawl is mounted to the piston for rotation. The pawl includes an end having first and second portions and an opposing end having third and fourth portions. First and second stops are supported by the housing adjacent the pawl, and a biasing element is provided for biasing the piston, and hence the seal, away from the seat.

The piston is responsive to a cyclical application and removal of water movement there across in a direction from the upstream chamber to the downstream chamber caused by the cyclical operation of the pump between inactive and active conditions so as to move in reciprocal directions, which causes the pawl to sequentially interact with the first and second stops and rotate or pitch sequentially in a single direction so as to cycle into and between first, second, third, fourth, fifth, sixth, seventh, eight, ninth and tenth positions. In the first position of the pawl, the second portion engages the first stop and the third portion registers with the second stop, the pump is in the inactive condition and the biasing element biases the seal away from the seat. In the second position of the pawl, the third and fourth portions engage the second stop and the first portion registers with the first stop, the pump is in the active condition, the bias of the biasing element is overcome by the water movement and the seal is located at a fixed position away from the seat, which permits the pump to pull water from the swimming pool through the skimmer device and the vacuum system. In the third position of the pawl, the first portion engages the first stop and the fourth portion registers with the second stop, the pump is in the inactive condition and the biasing element biases the seal away from the seat. In the fourth position of the pawl, the fourth portion engages the second stop, the pump is in the active condition, the bias of the biasing element is overcome by the water movement and the seal is positioned away from the seat. In the fifth position of the pawl, the third portion registers with the first stop, the pump is in the active condition, the bias of the biasing element is overcome by the water movement and the seal is positioned against the seat isolating the upstream chamber from the downstream chamber, which permits the pump to pull water from the swimming pool only through the vacuum system.

In the sixth position of the pawl, the third portion engages the first stop and the second portion registers with the second stop, the pump is in the inactive condition and the biasing element biases the seal away from the seat. In the seventh position of the pawl, the first and second portions engage the second stop and the fourth portion registers with the first stop, the pump is in the active condition, the bias of the biasing element is overcome by the water movement and the seal is located at fixed position away from the seat. In the eighth position of the pawl, the fourth portion engages the first stop and the first portion registers with the second stop, the pump is in the inactive condition and the biasing element biases the seal away from the seat. In the ninth position of the pawl, the first portion engages the second stop, the pump is in the active condition, the bias of the biasing element is overcome by the water movement and the seal is positioned away from the seat. In the tenth position of the pawl, the second portion registers with the first stop, the pump is in the active condition, the bias of the biasing element is overcome by the water movement and the seal is positioned against the seat isolating the upstream chamber from the downstream chamber. This completes the entire cycle of movement of the pawl in response to reciprocal movement of piston and is repeated as the pump continues to operate between its inactive and active conditions for facilitating a cycling between a simultaneous operation of the skimmer device and the vacuum system and a single operation of only the vacuum system, and this is, of course, reversed if the coupling of the skimmer device and the vacuum system to the housing is reversed.

In a preferred embodiment, the biasing element is at least one compression spring having an end coupled to the piston and another end coupled to the housing. The piston is mounted for reciprocal movement to an extension of the housing that depends from a removably attached lid. The extension is reciprocally adjustable in opposition to the seat by way of an adjustment member, which includes an elongate element having a head secured to the lid for rotation and a threaded segment threadably associated with a complemental threaded segment of the extension. The first and second stops are preferably carried by the extension.

The seal is an annular body having an annular sealing surface that is capable of sealing substantially against the seat for preventing water from flowing from the upstream chamber to the downstream chamber. A relief valve assembly is associated with the seal and is movable between a closed condition to an open condition for allowing water to pass from the upstream chamber to the downstream chamber when the seal is sealed against the seat and when the pressure in the downstream chamber becomes insufficient to keep the relief valve assembly closed. The relief valve assembly includes openings extending through the seal, a plate positioned against the seal closing the openings in a direction facing the downstream chamber, and a biasing assembly for biasing the plate against the seal. The biasing assembly includes an element or extension extending away from the seal toward the second chamber, and a compression spring captured between a head of the extension and the plate.

BRIEF DESCRIPTION OF THE DRAWINGS

Referring to the drawings.

DETAILED DESCRIPTION OF A PREFERRED EMBODIMENT

Figure 1:
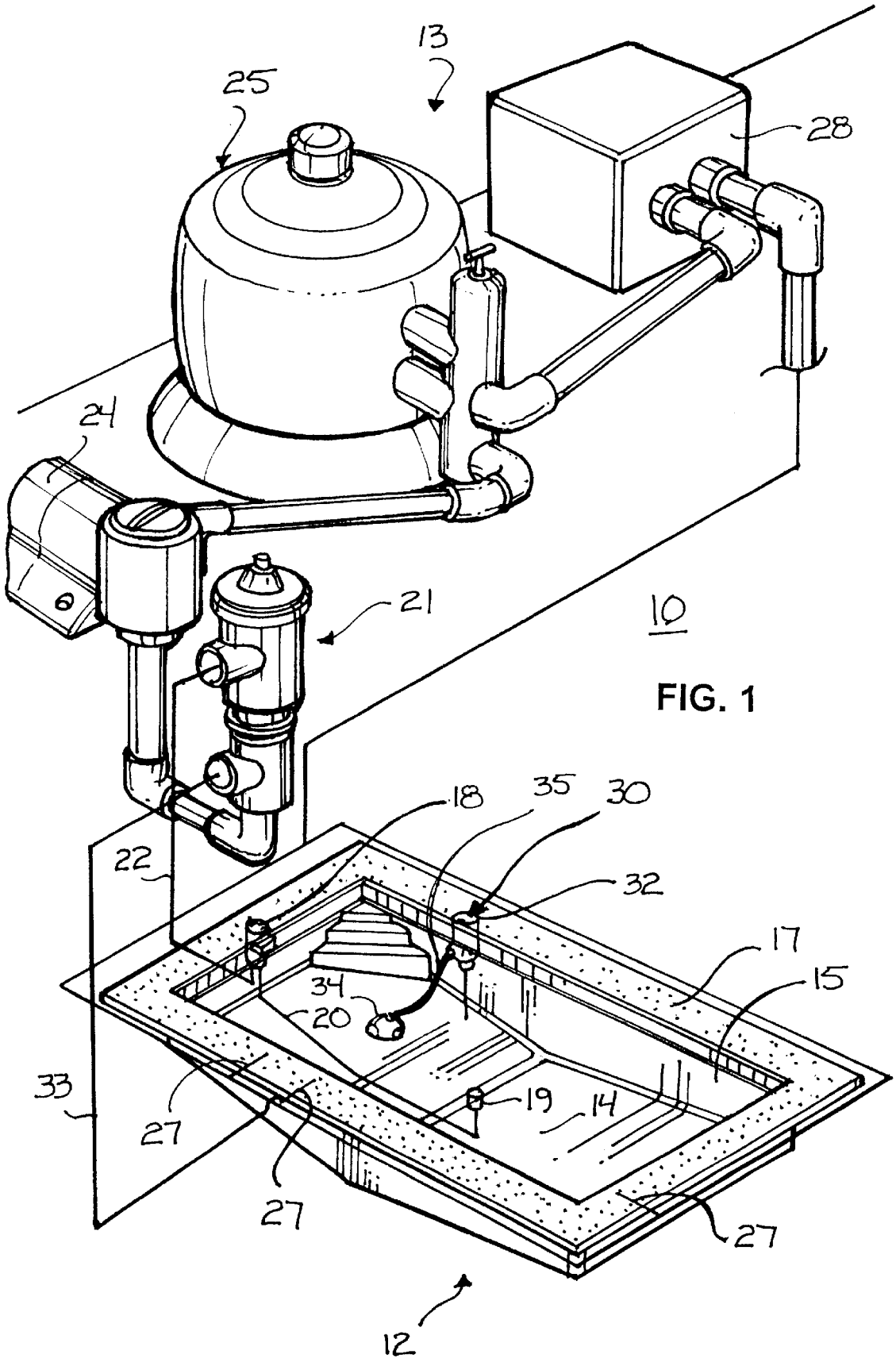
FIG. 1 is perspective view of a valve system, constructed in accordance with the teachings of the present invention, as it would appear in a swimming pool installation.

Turning to the drawings, FIG. 1 illustrates a swimming pool installation 10 including a swimming pool 12 and a recirculating system 13. Swimming pool 12 is substantially any type known to those skilled in the art, and includes a floor 14, sidewall 15 and a deck 17. Recirculating system 13 includes a skimmer device 18 mounted adjacent sidewall 15 and into deck 17, a main drain 19 mounted in floor 14 and coupled to skimmer device 18 by a conduit 20, and a vacuum system 30. A conduit 22 couples skimmer device 18 to a valve system 21, which is in turn coupled to a pump 24, which is configured to cycle between inactive and active conditions. In the active condition, pump 24 draws pool water through main drain 19 and the skimmer device 18 and valve system 21, forcing the water through a filter assembly 25 and back into swimming pool 12 through discharge outlets 27. Skimmer device 18 is furnished with a strainer basket and a removable lid (not shown) for allowing the strainer basket to be removed and cleaned. As will be apparent to one skilled in the art, additional elements may be added to recirculating system 13, such as a water heater 28 coupled between filter assembly 25 and discharge outlets 27.

Vacuum system 30 includes a vacuum module 32 mounted adjacent sidewall 15 and into deck 17. A conduit. 33 couples vacuum module 32 to valve system 21. A vacuum device 34 is coupled to vacuum module 32 by a vacuum hose 35. As pump 24 draws water through vacuum system 30, suction is created within vacuum module 32, which is communicated along vacuum hose 35 to vacuum device 34. This suction picks up debris with the pool water and provides motive force for vacuum device 34. Water and debris pulled through vacuum hose 35 enters vacuum module 32 through an inlet and exits through an outlet after passing through a strainer basket (not shown) disposed therein, which collects the larger debris while the smaller particles pass through conduit 33 to filter assembly 25. Vacuum module 32 is furnished with a removable lid (not shown) for allowing the strainer basket to be removed and cleaned.

Set forth for purposes of orientation and reference in connection with the ensuing detailed description of the preferred embodiment of the instant invention, the foregoing brief description of swimming pool installation 10 is intended to be generally representative of typical, swimming pool installations. Details not specifically illustrated and described will be readily understood and appreciated by those skilled in the art.

Figure 2:
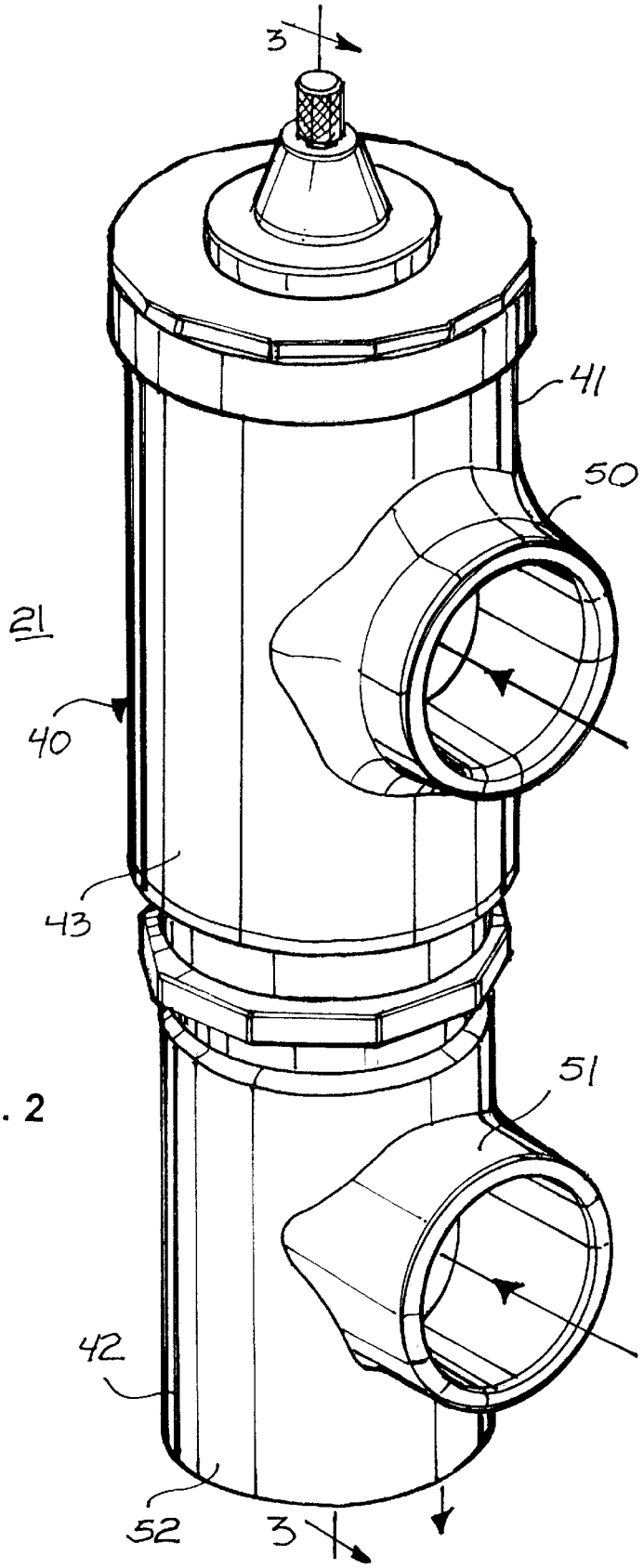
FIG. 2 is a perspective view of the valve system of FIG. 1.
Figure 3:
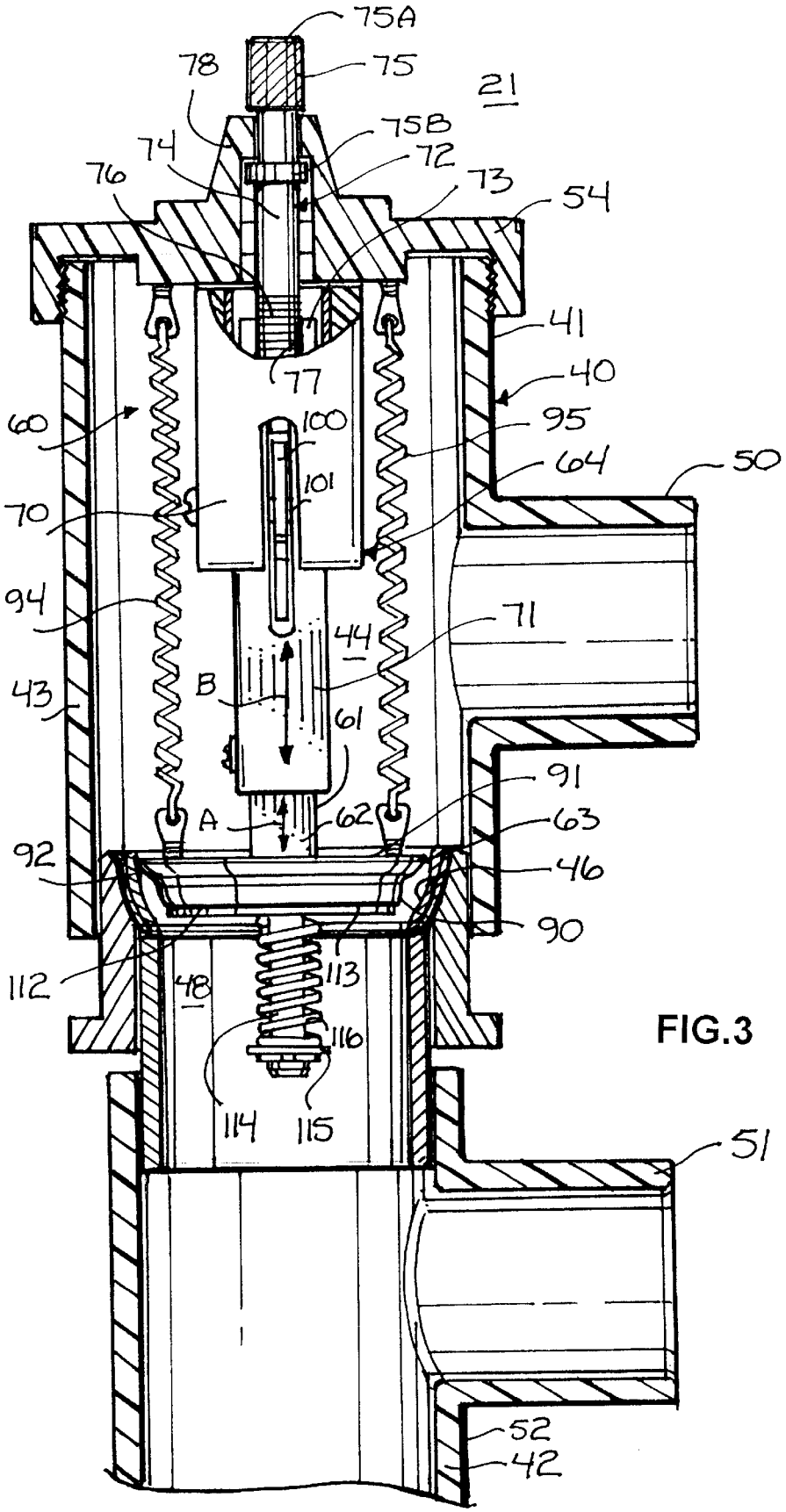
FIG. 3 is a sectional view taken along line 3—3 of FIG. 1 and showing a valve assembly.

Valve system 21 couples skimmer device 18, main drain 19 and vacuum system 30 to pump 24. Referring to FIGS. 2 and 3, valve system 21 includes a module or housing 40 having opposing ends 41,42 and a sidewall 43 extending therebetween, defining a valve chamber 40. As shown in FIG., a valve seat 46 extends into valve chamber 44 from sidewall 43 and divides chamber 44 into an upstream chamber 47 and a downstream chamber 48. An inlet 50 communicating with upstream chamber 47 is adapted to receive conduit 22, an inlet 51 communicating with downstream chamber 48 is adapted to receive conduit 33, and an outlet 52 communicating with downstream chamber 48 is adapted to be coupled to pump 24 by way of a conduit, and the coupling of conduits 22,33 can be reversed. End 41 is closed by a plate or lid 54. A valve assembly 60 is axially disposed in upstream chamber 47. In this embodiment, valve assembly 60 is attached to and supported by lid 54, and it may be mounted to housing 40 at other locations so as to extend axially into upstream chamber 47. Lid 54 is attached to end 41 with a threaded engagement assembly for facilitating easy attachment and removal. It will be understood by those skilled in the art that other devices for coupling lid 54 may be employed such as a friction fit, the use of O-rings or similar seals, etc. In a proper installation, recirculating system 13 and valve system 21 are primed with pool water. When pump 24 activates, it pulls pool water from swimming pool 12 through valve system 21.

Figure 4:
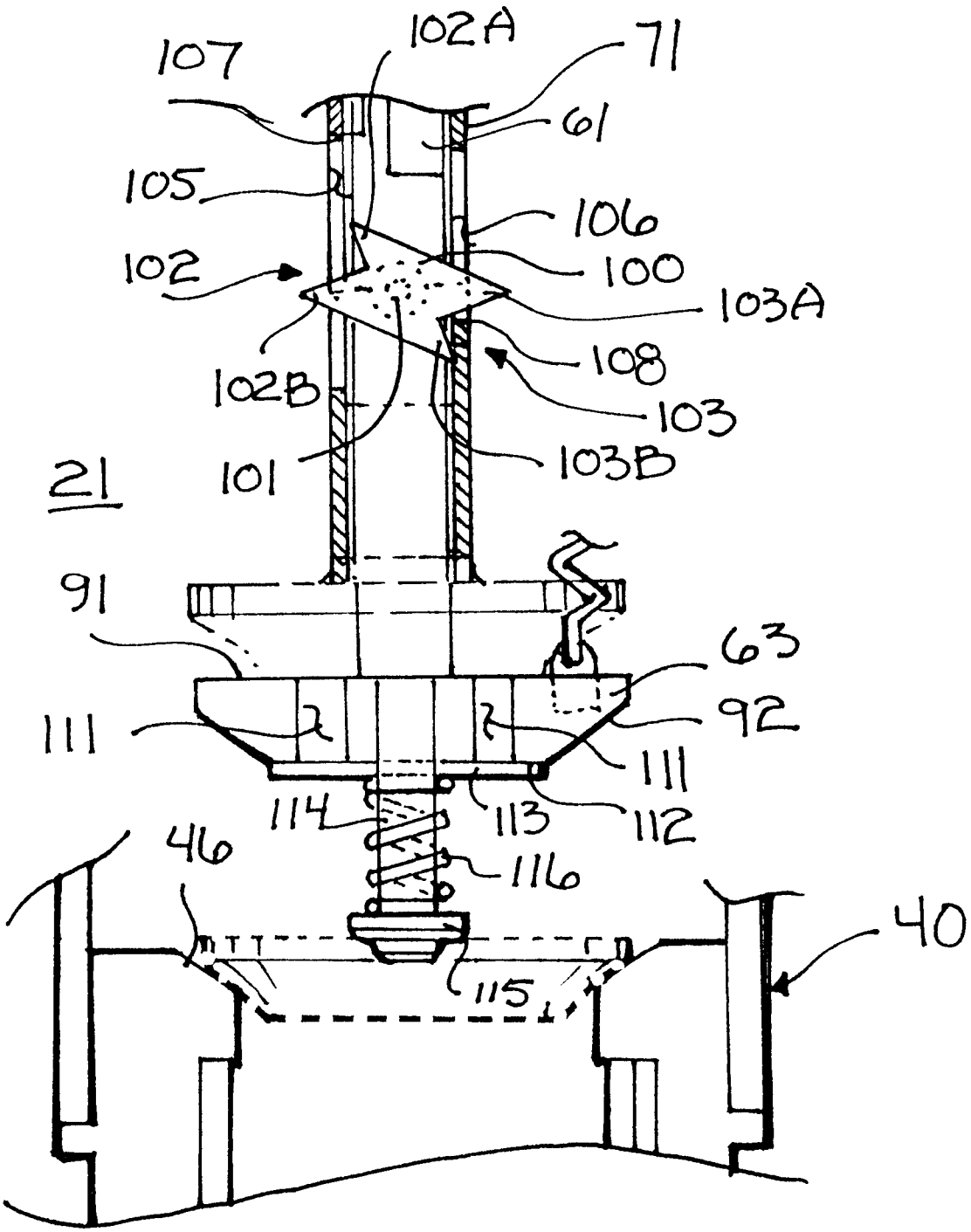
FIG. 4 is a sectional view of the valve assembly of FIG. 3 and showing a pawl.

Referring to FIGS. 3 and 4, valve assembly 60 includes a piston 61 having an end 62, which is furnished with an attached seal 63, and another end that is mounted partially within a support structure 64 for reciprocal movement in opposition to seat 46 as indicated by the double arrowed line A. In this embodiment, support structure 62 is considered an extension of housing 40 and includes a base 70, which is attached to and extends from the underside of lid 54 into upstream chamber 47. A sleeve 71 is mounted partially within base 70 for reciprocal movement in opposition to seat 46 as indicated by the double arrowed line B. Base 70 and sleeve 71 are considered part of housing 40 and piston 61 is mounted partially within sleeve 71 for reciprocal movement. An adjustment member 72 is coupled to lid 54 and to an end 73 of sleeve 71 that is directed toward the underside of lid 54, and permits the reciprocal adjustment of sleeve 71. Adjustment member 72 is an elongate element 74 having a head 75 that is attached to lid 54 for rotation and an opposing threaded segment or portion 76 that is threadably engaged to a complemental threaded segment or portion 77 is formed into end 73 of sleeve 71. By applying a rotational force to head 75, such as by hand, adjustment member 72 may be rotated in the counterclockwise and clockwise directions for rotating threaded portion 76 in relation to complemental threaded portion 77 for effecting reciprocal adjustment of sleeve 71, and thus piston 61, away from and toward seat 46, or otherwise away from and toward the underside of lid 54. In this embodiment, head 75 extends through an opening formed through lid 54 and includes opposing enlargements 75A,75B that capture opposite sides of a raised aspect 78 of lid 54. Portion 75A extends outwardly and is available to be taken up by hand for applying rotational force.

Seal 63 is considered part of piston 61 and includes a body 90 having major face 91 that faces the underside of lid 54 or that otherwise faces away from seat 46, and a substantially opposing annular sealing surface 92 that is capable of sealing substantially against seat 46, which is also annular. Seal 63 is located substantially within upstream chamber 47 and opposes seat 46. In response to reciprocal movement of piston 61, seal 63 is movable between a retracted condition away from seat 46 and an extended condition toward and against seat 46, in which sealing surface 82 engages and seals substantially against seat 46 isolating upstream chamber 47 from downstream chamber 48. The ability to reciprocally adjust sleeve 71 allows an operator to ensure that seal 63 seals against seat 46 in its extended condition, and sleeve 71 may be adjusted as needed to ensure this sealing engagement. Compression springs 94,95 attach face 91 to the underside of lid 54. The ends of springs 94 are secured with attached couplings 96. Springs 94,95 pull against seal 63 and bias piston 61, and hence seal 63, away from seat 46. Although two springs are shown, less or more may be employed. It will be understood by those skilled in the art that other devices for biasing piston 61 away from seat 46 by pushing or pulling may be employed such as one or, more elastic bands, elongate spring elements, etc.

As best seen in FIG. 4, a pawl 100 is mounted to piston 61 for rotation by way of a pin 101. Pin 101 is attached to piston 61 at a generally intermediate location along the length of piston 61, and pawl 100 and pin 101 rotate together. Pawl 100 may be configured to rotate relative to pin 101 if desired. Pawl 100 is generally flat in cross section and includes an end 102 having opposing fingers or portions 102A,102B, and an opposing end 103 having opposing fingers or portions 103A,103B. Pawl 100 is located in a receptacle or slot 104 formed in piston 61. Opposing open ends of slot 104 correspond to opposing windows 105,106 formed on either side of sleeve 71. Sleeve 71 is furnished with attached stops 107,108. Stop 107 is located at, and generally defines, an upper end of window 105, and stop 108 is located at, and generally defines, a lower end of window 106.

As previously mentioned, pump 24 cycles between inactive and active conditions. In the active condition, pump 24 draws pool water through main drain 19 and the skimmer device 18 and valve system 21, forcing the water through a filter assembly 25 and back into swimming pool 12 through discharge outlets 27. Pool water is drawn through valve chamber 44 through inlets 50 and 51, and pool water generally passes through valve chamber 44 in a direction from upstream chamber 47 to downstream chamber 48. Piston 61 is responsive to this cyclical application and removal of water movement there across in a direction from upstream chamber 47 to downstream chamber 48 caused by the cyclical operation of pump 24 between the inactive and active conditions so as to move in reciprocal directions as denoted by the double arrowed line A in FIGS. 3 and 4. The responsiveness of piston 61 to water movement through system 21 is facilitated by seal 63 and, more particularly, by face 91. Because face 91 opposes the flow of water movement and defines a large surface area, the flow of water across and against face 91 in the active condition of pump 24 overcomes the bias of springs 94,95 and forces piston 61 toward seat 46. In the absence of water flow in the inactive condition of pump 24, springs 94,95 bias piston 61, and thus seal 63, away from seat 46.

Figure 5:
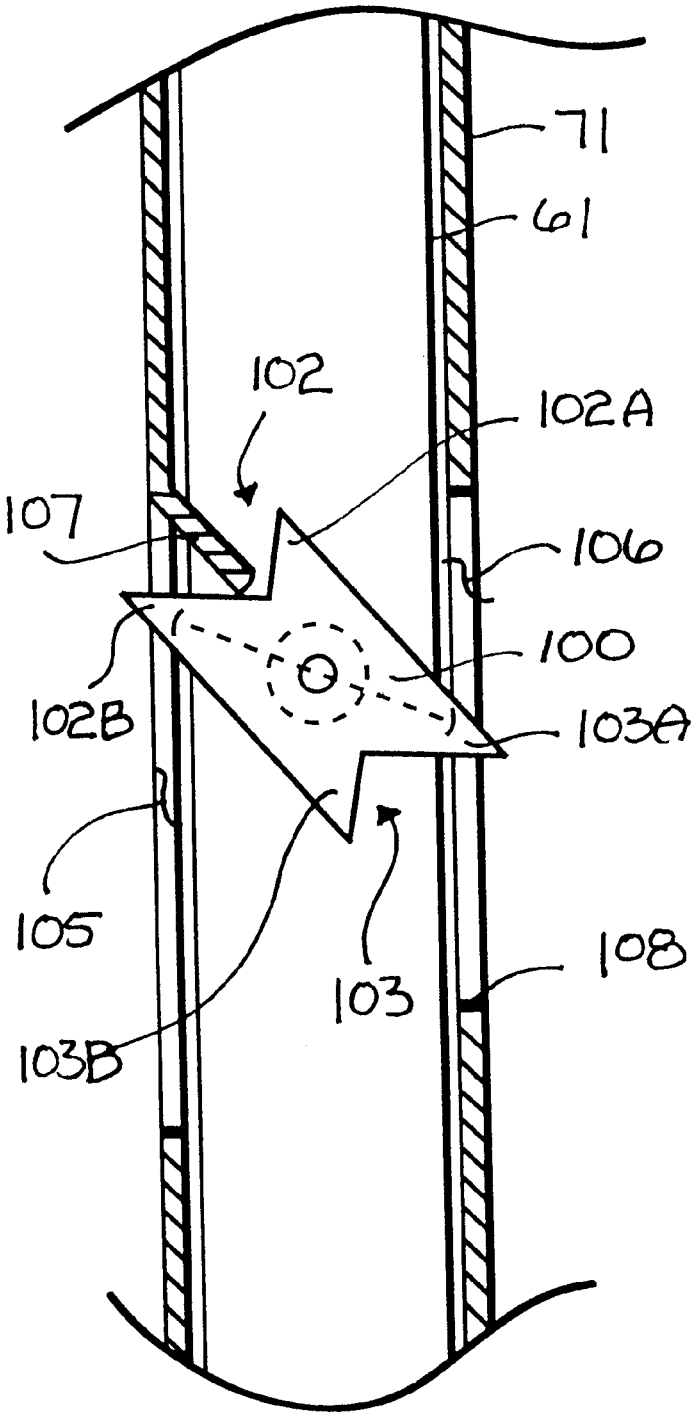
FIGS. 5–14 show a sequence of operation of the pawl of FIG. 4.
Figure 6:
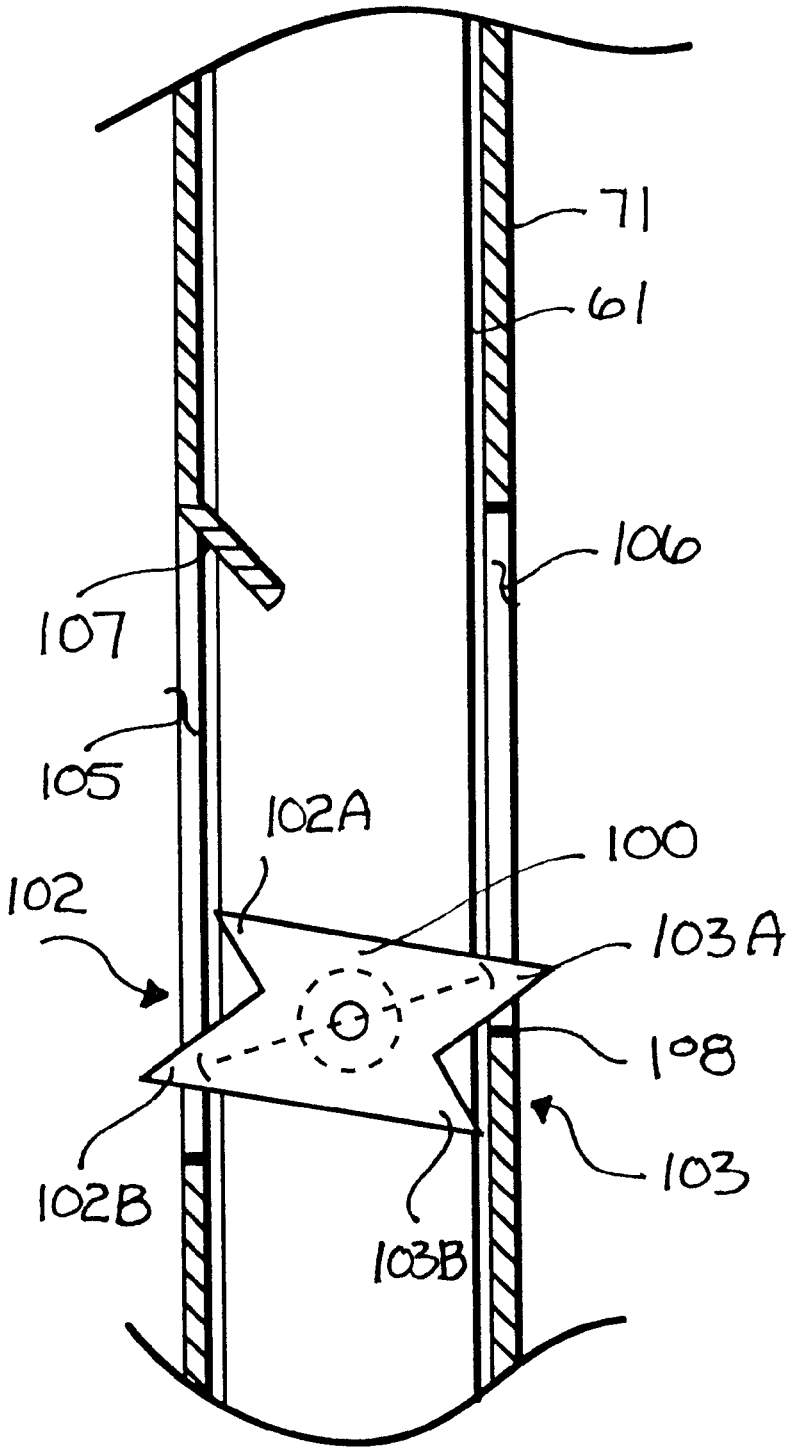
Figure 7:
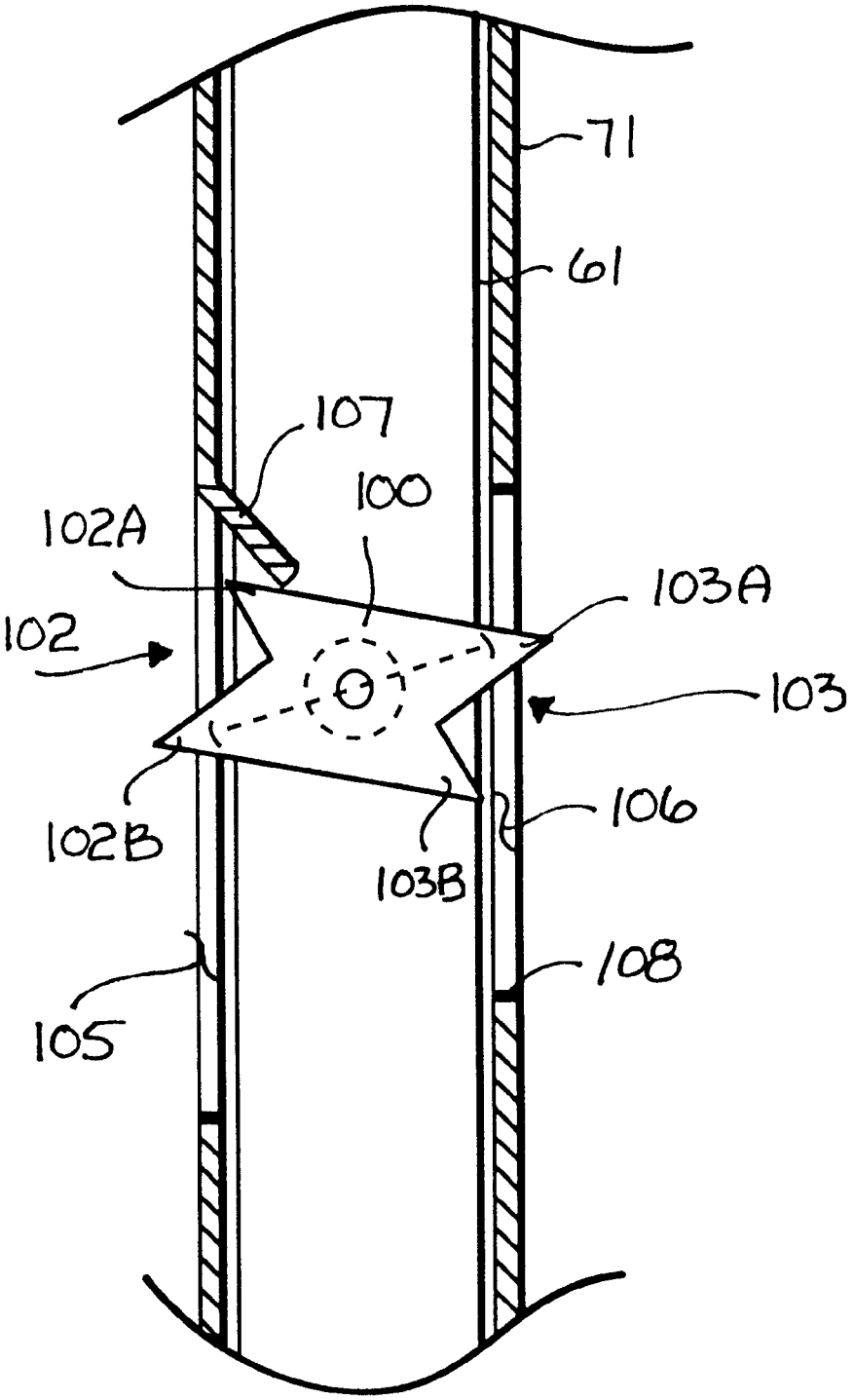
Figure 8:
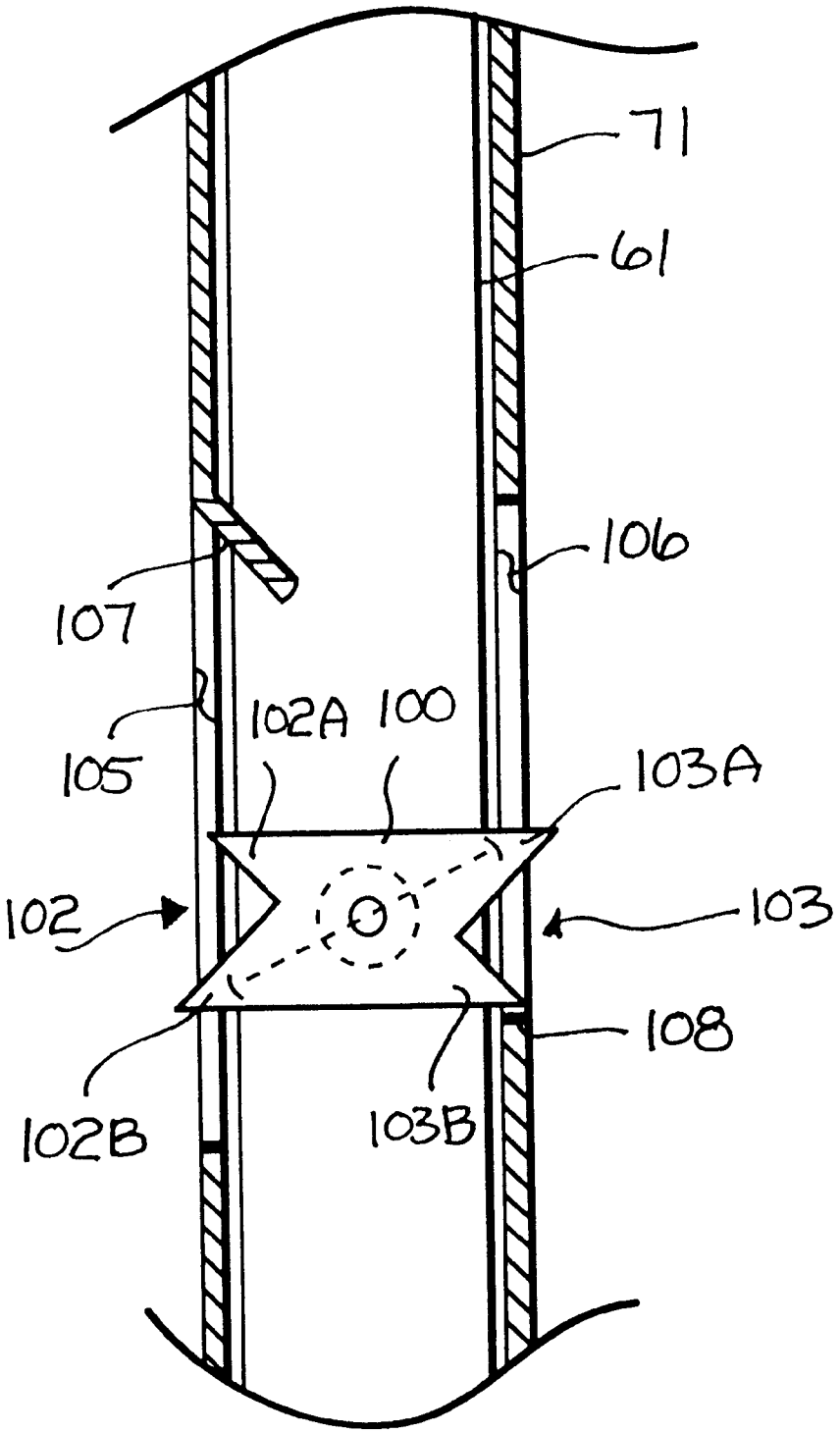
Figure 9:
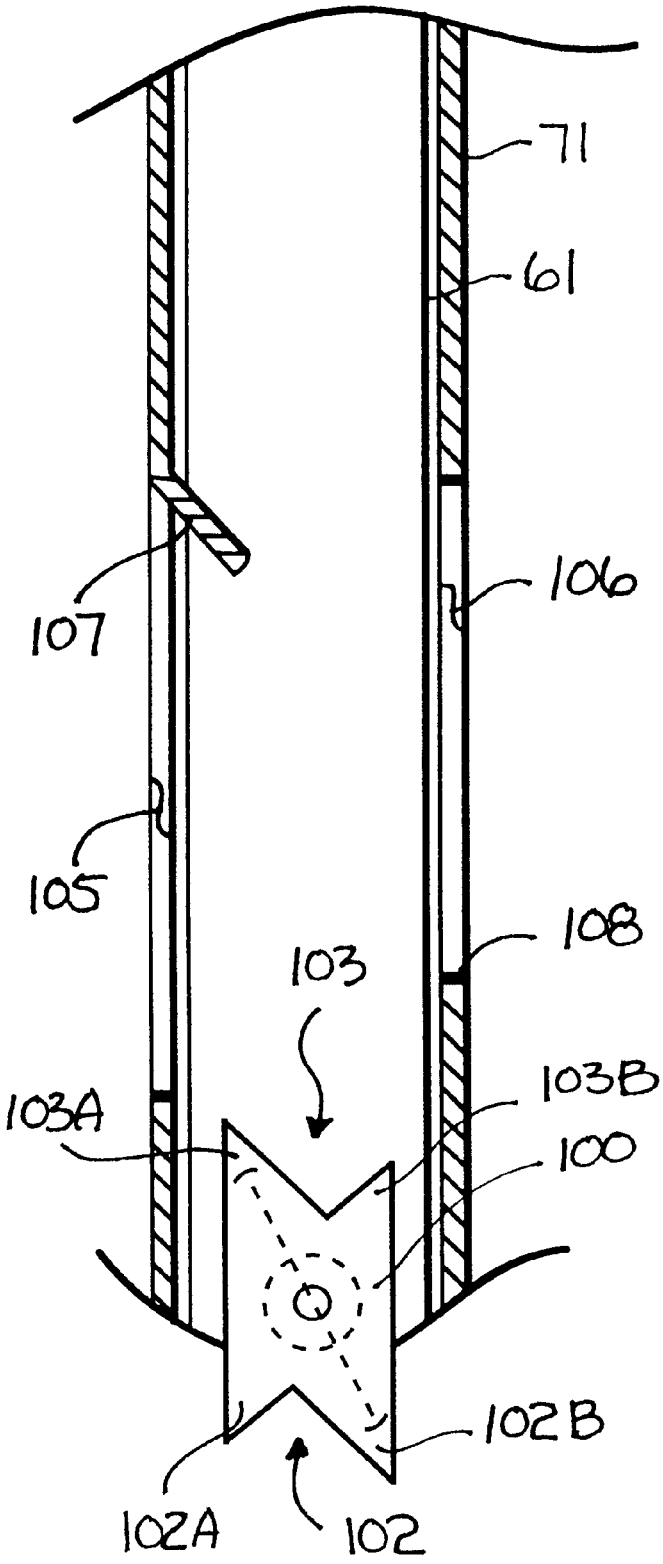

The reciprocal movement of piston 61, which occurs in response to the absence and presence of water movement through housing 40 caused by the movement of pump 24 between the inactive and active conditions, causes pawl 100 to sequentially interact with stops 107,108 and rotate or pitch sequentially in a single direction so as to cycle into and between first, second, third, fourth, fifth, sixth, seventh, eight, ninth and tenth positions. In the first position of pawl 100 in FIG. 5, portion 102B engages stop 107 and portion 103A registers with stop 108, pump 24 is in the inactive condition and springs 94,95 bias piston 61, and thus seal 63, away from seat 46. When pump 24 becomes active, the bias of springs 94,95 is overcome and piston 61 moves toward seat 46 and pawl 100 assumes its second position. In the second position of pawl 100 in FIG. 6, portions 103A,103B engage stop 108 in a cantilevered fashion and portion 102A registers with stop 107, pump 24 in the active condition, the bias of springs 94,95 is overcome by water movement against face 91 and seal 63 is held at a fixed position away from seat 46, which allows pump 24 to pull water through skimmer device 18 and vacuum system 30 simultaneously. When pump 24 becomes inactive, the bias of springs 94,95 moves piston 61 away from seat 46 and pawl 100 assumes its third position. In the third position of pawl 100 as shown in FIG. 7, portion 102A engages stop 107 and portion 103B registers with stop 108, pump 24 is in the inactive condition and springs 94,95 bias seal 63 away from seat 46. When pump 24 again becomes active, the bias of springs 94,95 is overcome and piston 61 moves toward seat 46 and pawl 100 assumes its fourth position, which is an intermediate position between its third and fifth positions. In the fourth position as shown in FIG. 8, portion 103B engages stop 108, pump 24 is in the active condition, the bias of springs 94,95 is overcome by water movement and seal 63 is spaced from, yet traveling toward, seat 46. As pump 24 continues to be active, the bias of springs 94,95 remains overcome, piston 61 moves toward seat 46 and portion 103B bears against stop 108, which forces pawl 100 to rotate into its fifth position. In the fifth position as shown in FIG. 9, portion 103A registers with stop 107, pump 24 is in the active condition, the bias of springs 94,95 is overcome by water movement against face 91 and seal 63 is positioned against seat 46, which isolates upstream chamber 47 from downstream chamber 48 and permits pump 24 to pull water only through vacuum system 30.

Figure 10:
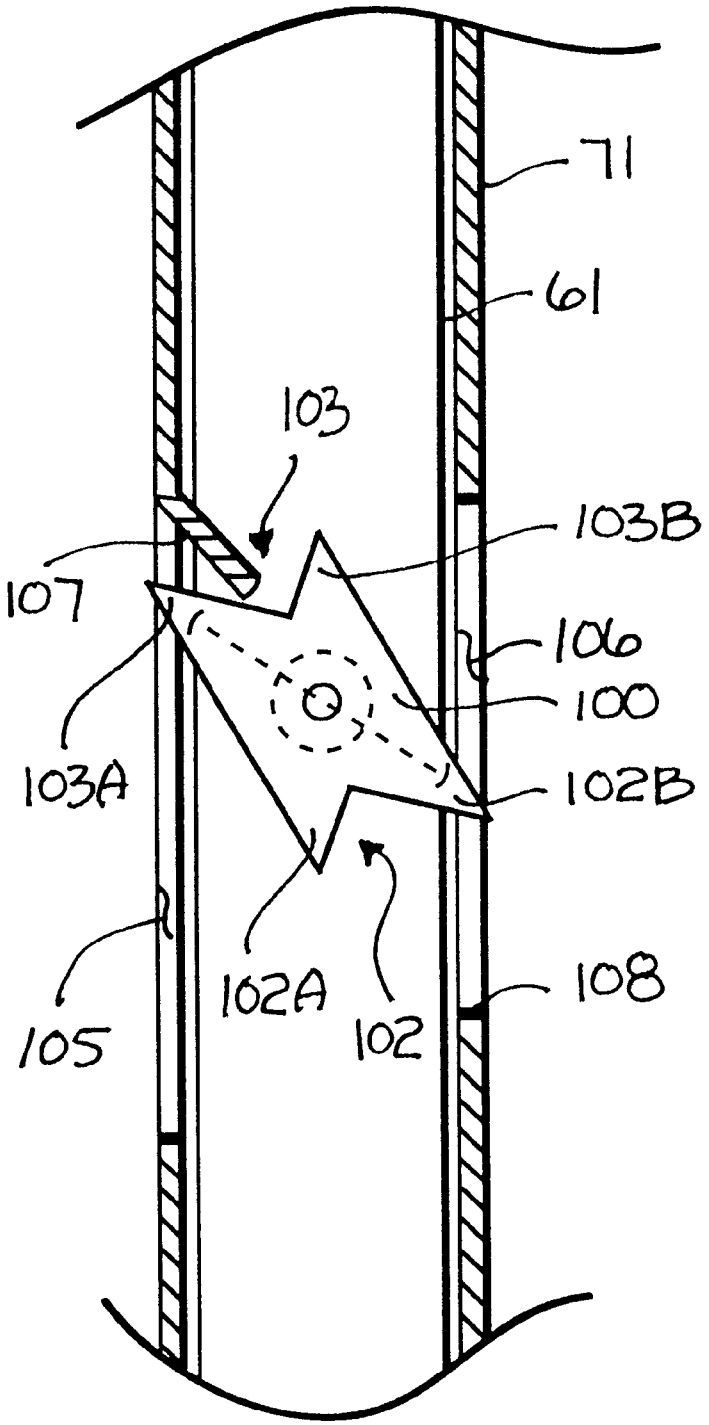
Figure 11:
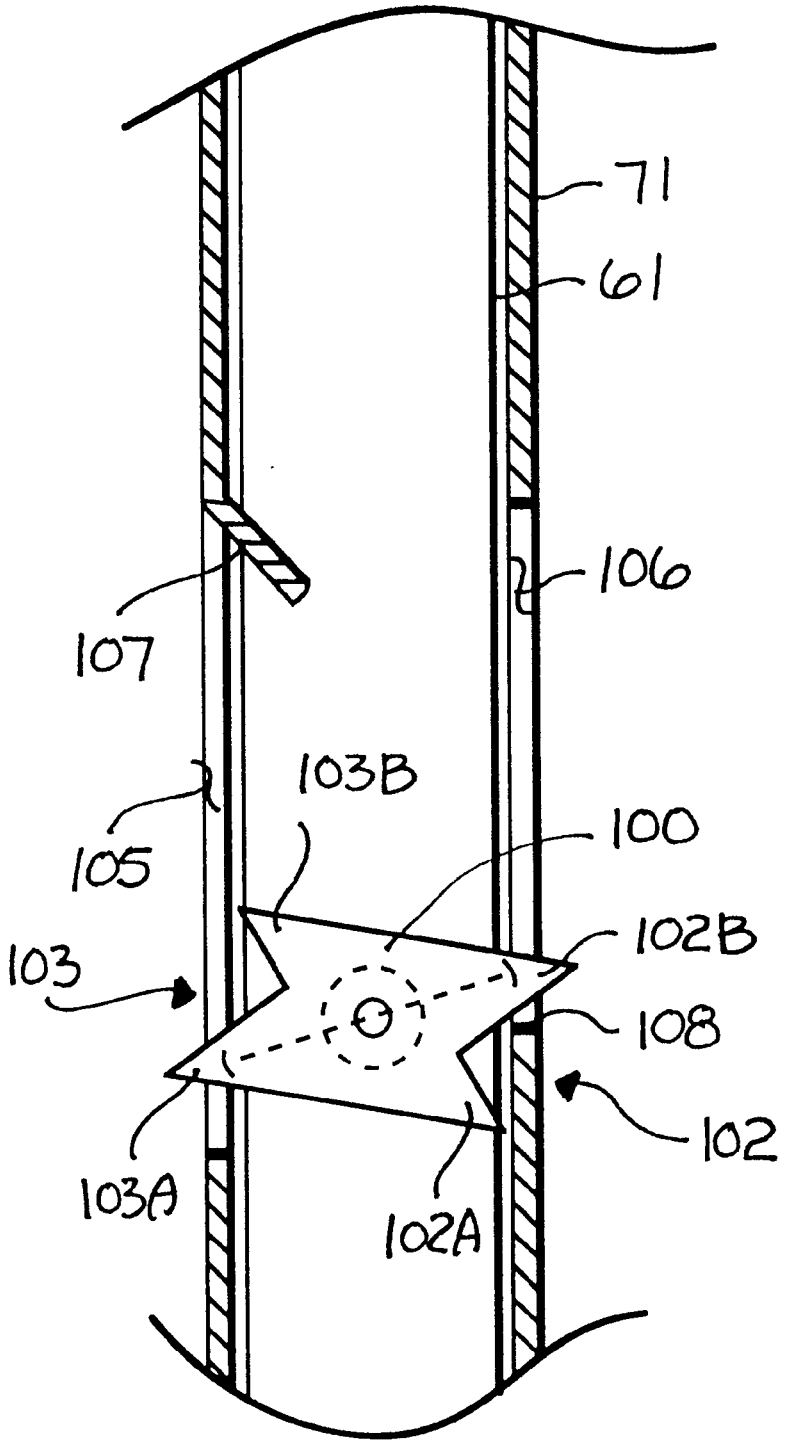
Figure 12:
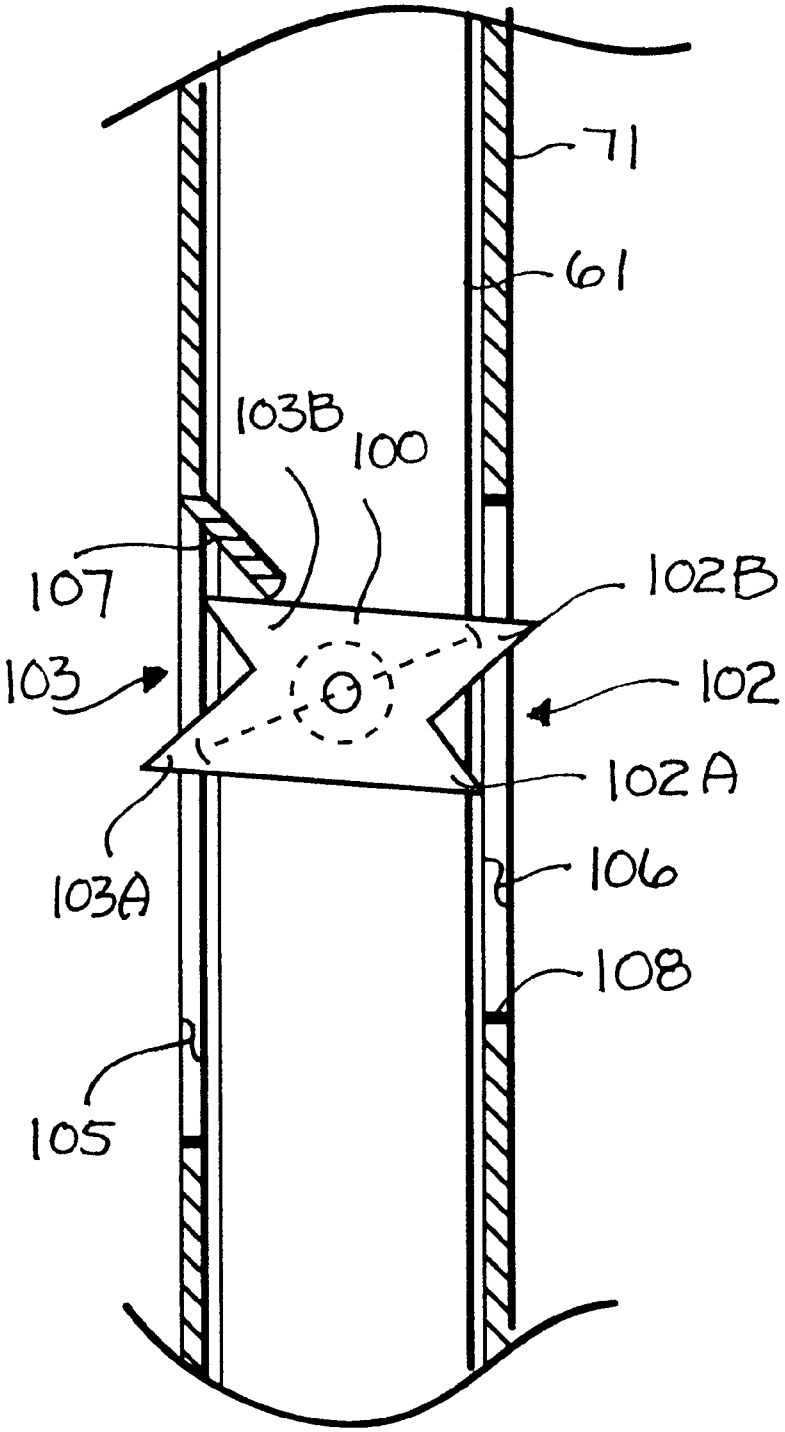
Figure 13:
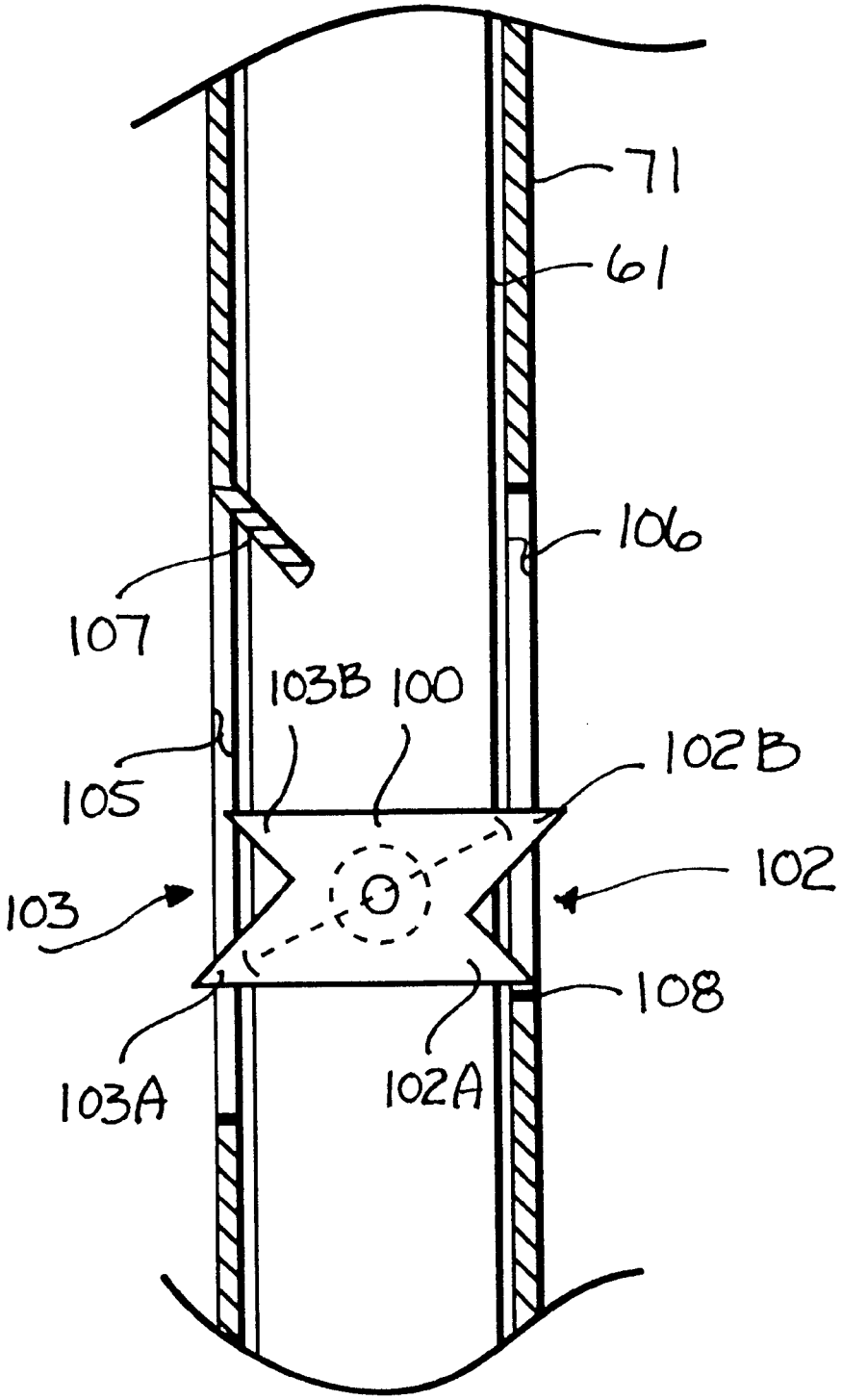
Figure 14:
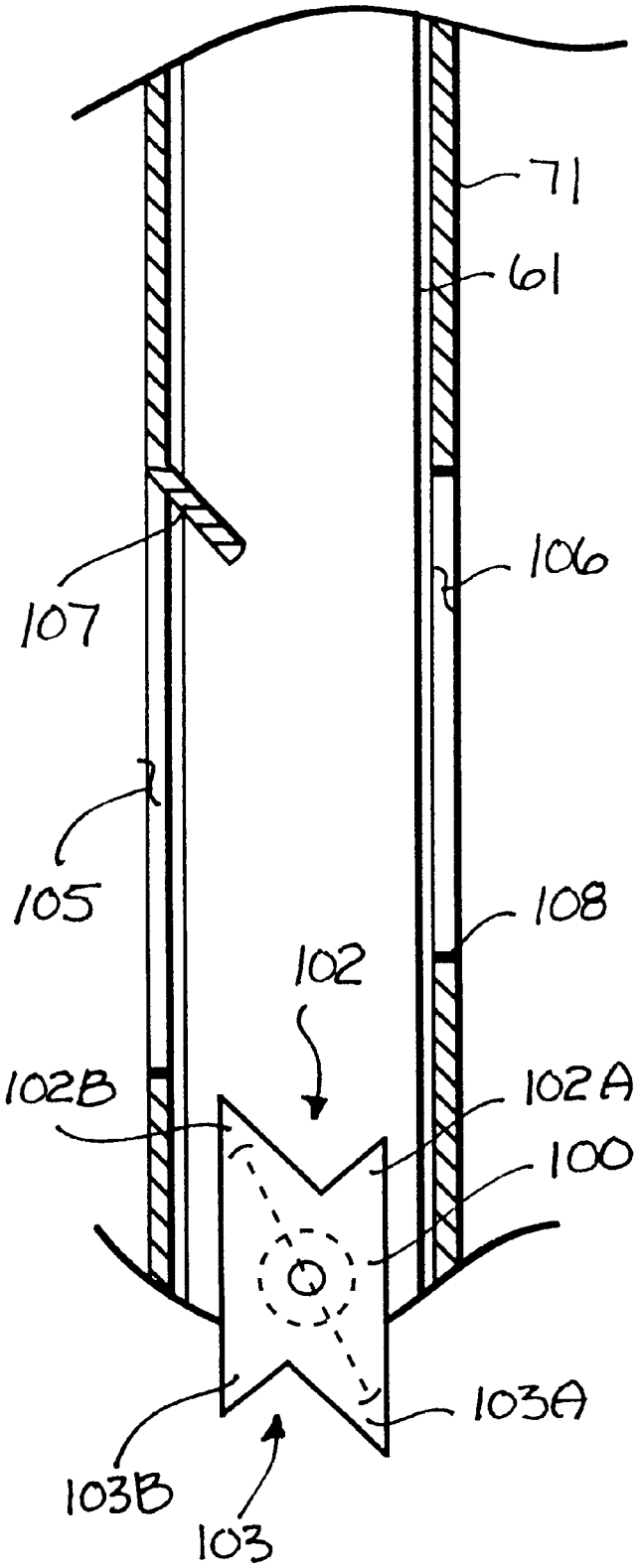

When pump 24 again becomes inactive, the bias of springs 94,95 moves piston 61 away from seat 46 and pawl 100 assumes its sixth position. In the sixth position as shown in FIG. 10, portion 103A engages stop 107 and portion 102B registers with stop 108, pump 24 is in the inactive condition and springs 94,95 bias piston 61, and thus seal 63, away from seat 46. When pump 24 becomes active, the bias of springs 94,95 is overcome and piston 61 moves toward seat 46 and pawl 100 assumes its seventh position. In the seventh position in FIG. 11, portions 102B,102A engage stop 108 in a cantilevered fashion and portion 103B registers with stop 107, pump 24 in the active condition, the bias of springs 94,95 is overcome by water movement against face 91 and seal 63 is held at a fixed position away from seat 46, which allows pump 24 to pull water through skimmer device 18 and vacuum system 30 simultaneously. When pump 24 becomes inactive, the bias of springs 94,95 moves piston 61 away from seat 46 and pawl 100 assumes its eighth position. In the eighth position as shown in FIG. 12, portion 103B engages stop 107 and portion 102A registers with stop 108, pump 24 is in the inactive condition and springs 94,95 bias seal 63 away from seat 46. When pump 24 again becomes active, the bias of springs 94,95 is overcome and piston 61 moves toward seat 46 and pawl 100 assumes its ninth position, which is an intermediate position between its eighth and tenth positions. In the ninth position as shown in FIG. 13, portion 102A engages stop 108, pump 24 is in the active condition, the bias of springs 94,95 is overcome by water movement and seal 63 is spaced from, yet traveling toward, seat 46. As pump 24 continues to be active, the bias of springs 94,95 remains overcome, piston 61 moves toward seat 46 and portion 102A bears against stop 108, which forces pawl 100 to rotate into its tenth position. In the tenth position as shown in FIG. 9, portion 102B registers with stop 107, pump 24 is in the active condition, the bias of springs 94,95 is overcome by a water movement against face 91 and seal 63 is positioned against seat 46, which isolates upstream chamber 47 from downstream chamber 48 and permits pump 24 to pull water only through vacuum system 30. When pump 24 again becomes inactive, the bias of springs 94,95 moves piston 61 away from seat 46 and pawl 100 assumes its first position. This completes the entire cycle of movement of pawl 100 in response to reciprocal movement of piston 61 and is repeated as pump 24 continues to operate between its inactive and active conditions.

In response to the presence and absence of water movement through valve system 21 caused by the cyclical operation of pump 24 between the inactive and active conditions, valve system 21 will alternate between a vacuum/skimmer mode pulling pool water through skimmer device 18 and vacuum system 30 simultaneously, and a vacuum mode pulling pool water only through vacuum system 30. By toggling between these two modes of operation, a swimming pool is kept clean and the strain and wear and tear on pump 24 and vacuum system 30 is reduced. This can be reversed by reversing the coupling of skimmer device 18 and vacuum system 30 to valve system 21. Piston 61 and sleeve 71 may be furnished with any variety of stop or guide structure for preventing piston 61 from falling away from sleeve 71.

If debris clogs or substantially clogs vacuum system 30 or if any other malfunction should occur that would inhibit water from being pulled through vacuum system 30 in the vacuum mode of valve system 21, the invention includes a relief valve assembly 110 for protecting pump 24 from becoming damaged. Regarding FIGS. 3 and 4, relief valve assembly 110 is associated with seal 63 and is movable between a closed condition to an open condition for allowing water to pass from upstream chamber 47 to and through downstream chamber 48 when the water pressure in downstream chamber 48 becomes insufficient to keep relief valve assembly 110 closed when seal 63 is engaged against seat 46 in the vacuum mode of valve system 21.

Relief valve assembly 21 includes openings 111 (shown only in FIG. 4) extending through seal 63 from face 91 to an opposing face 112 of seal 63. A plate 113 is positioned against face 112 closing openings 111. An extension 114 of seal 63 extends away from face 112 and terminates with a head 115. A compression spring 116 encircles extension 114, is captured between head 15 and plate 113 and biases plate 113 against face 112. In the event water is prevented from passing through vacuum system 30, the water suction against plate 113 will overcome the bias of spring 116 and plate 113 will move away from face 112, which will allow water to flow from upstream chamber 47 to and through downstream chamber 48 through openings 111. Although two openings 111 are illustrated, more or less may be employed. When the water pressure or suction against plate 113 becomes insufficient to overcome the bias of spring 116, spring 116 will bias plate 113 against face 112, closing openings 111. This process repeats itself if necessary and prevents pump 24 from operating without water and from thus becoming damaged. Because of its simplicity, spring 116 is preferred for biasing plate 113 against face 112. It will be understood by those skilled in the art that other devices for biasing piston plate 113 against face 112 by pushing or pulling may be employed such as one or more elastic bands, elongate spring elements, etc.

Various changes and modifications to the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

1. In a swimming pool installation including a swimming pool and a recirculating system having first and second pool cleaning devices and a pump that cycles between inactive and active conditions, apparatus comprising:

a housing defining a main chamber and a seat extending from the housing dividing the main chamber into a first chamber which is coupled to the first cleaning device and a second chamber which is coupled to the second cleaning device and to the pump;

a piston having a seal and mounted in the main chamber for reciprocal movement of the seal away from the seat and against the seat isolating the first chamber from the second chamber;

a pawl mounted to the piston for rotation;

first and second stops supported by the housing adjacent the pawl; and means for biasing the piston away from the seat;

the piston being responsive to a cyclical application and removal of water movement there across in a direction from the first chamber to the second chamber caused by the cyclical operation of the pump between inactive and active conditions so as to move in reciprocal directions, which causes the pawl to sequentially interact with the first and second stops and cycle between a locked condition against one of the first and second stops securing the seal away from the seat and an unlocked condition permitting the seal to move against the seat.

2. Apparatus of claim 1, wherein the means for biasing the piston comprises at least one compression spring having an end coupled to the piston and another end coupled to the housing.

3. Apparatus of claim 1, wherein the piston is mounted for reciprocal movement to an extension of the housing which depends from a removably attached lid.

4. Apparatus of claim 3, wherein the extension is reciprocally adjustable in opposition to the seat.

5. Apparatus of claim 4, further including an adjustment member for reciprocally adjusting the extension comprising an elongate element having a head secured to the lid for rotation and a threaded segment threadably associated with a complemental threaded segment of the extension.

6. Apparatus of claim 3, wherein the first and second stops are carried by the extension.

7. Apparatus of claim 1, wherein the pawl comprises a body including ends each having portions which sequentially register and interact with the first and second stops in response to movement of piston in reciprocal directions.

8. Apparatus of claim 1, wherein the seal comprises an annular body having an annular sealing surface which is capable of sealing against the seat.

9. Apparatus of claim 1, further including a relief valve assembly associated with the seal which is movable between a closed condition to an open condition for allowing water to pass from the first chamber to the second chamber when the pressure in the second chamber is insufficient to keep the relief valve assembly closed when the seal is sealed against the seat.

10. Apparatus of claim 9, wherein the relief valve assembly comprises:

openings extending through the seal;

a plate positioned against the seal closing the openings in a direction facing the second chamber; and means for biasing the plate against the seal.

11. Apparatus claim 10, wherein the means for biasing the plate comprises:

an element extending away from the seal toward the second chamber; and a compression spring captured between a head of the element and the plate.

12. In a swimming pool installation including a swimming pool and a recirculating system, the recirculating system having first and second cleaning devices and a pump that cycles between inactive and active conditions, apparatus comprising:

a housing defining-first and second chambers;

a seat extending from the housing between the first and second chambers;

a first inlet of the housing in communication with the first chamber and coupled to the first cleaning device;

a second inlet of the housing in communication with the second chamber and coupled to the second cleaning device;

an outlet of the housing in communication with the second chamber and coup led to the pump;

a piston having, a seal and mounted to the housing in thee first chamber for reciprocal movement of the seal away from the seat and against the seat isolating the upper chamber from the lower chamber;

a pawl mounted to the piston for rotation;

first and second stops supported by the housing in the first chamber adjacent the pawl; and means for biasing the piston away from the seat;

the piston being responsive to a cyclical application and removal of water movement there across in a direction from the first chamber to the second chamber caused by the cyclical operation of the pump between the inactive and active conditions so as to move in reciprocal directions, which causes the pawl to sequentially interact with the first and second stops and cycle between a locked condition against one of the first and second stops securing the seal away from the seat in an active condition of the pump and an unlocked condition permitting the seal to move against the seat in a subsequent active condition of the pump.

13. Apparatus of claim 12, wherein the means for biasing the piston comprises at least one compression spring having an end coupled to the piston and another end coupled to the housing.

14. Apparatus of claim 12, wherein the piston is mounted for reciprocal movement to an extension of the housing that depends from a removably attached lid.

15. Apparatus of claim 14, wherein the extension is reciprocally adjustable in opposition to the seat.

16. Apparatus of claim 15, further including an adjustment member for reciprocally adjusting the extension comprising an elongate element having a head secured to the lid for rotation and a threaded segment threadably associated with a complemental threaded segment of the extension.

17. Apparatus of claim 14, wherein the first and second stops are carried by the extension.

18. Apparatus of claim 12, wherein the pawl comprises a body including ends each having portions which sequentially register and interact with the first and second stops in response to movement of piston in reciprocal directions.

19. Apparatus of claim 12, wherein the seal comprises an annular body having an annular sealing surface which is capable of sealing against the seat.

20. Apparatus of claim 12, further including a relief valve assembly associated with the seal which is movable between a closed condition to an open condition for allowing water to pass from the first chamber to the second chamber when the pressure in the second chamber is insufficient to keep the relief valve assembly closed when the seal is sealed against the seat.

21. Apparatus of claim 20, wherein the relief valve assembly comprises:

openings extending through the seal;

a plate positioned against the seal closing the openings in a direction facing the second chamber; and means for biasing the plate against the seal.

22. Apparatus claim 21, wherein the means for biasing the plate comprises:

an element extending away from the seal toward the second chamber; and a compression spring captured between a head of the element and the plate.

23. In a swimming pool installation including a swimming pool and a recirculating system having first and second pool cleaning devices and a pump that cycles between inactive and active conditions, apparatus comprising:

a housing defining a main chamber and a seat extending from the housing dividing the main chamber into an upstream chamber which is coupled to the first cleaning device and a downstream chamber which is coupled to the second cleaning device and to the pump;

a piston having a seal and mounted in the upstream chamber for reciprocal movement of the seal away from the seat and against the seat isolating the upstream chamber from the second chamber;

a pawl mounted to the piston for rotation, the pawl including an end having first and second portions and an opposing end having third and fourth portions;

first and second stops supported by the housing adjacent the pawl; and means for biasing the piston away from the seat;

the piston being responsive to a cyclical application and removal of water movement there across in a direction from the upstream chamber to the downstream chamber caused by the cyclical operation of the pump between inactive and active conditions so as to move in reciprocal directions, which causes the pawl to sequentially interact with the first and second stops and rotate in a single direction into and between:

a first position in which the second portion engages the first stop and the third portion registers with the second stop, the pump is in the inactive condition and the means biases the seal away from the seat;

a second position in which the third and fourth portions engage the second stop and the first portion registers with the first stop, the pump is in the active condition, the bias of the means is overcome by water movement and the seal is fixed away from the seat;

a third position in which the first portion engages the first stop and the fourth portion registers with the second stop, the pump is in the inactive condition and the means biases the seal away from the seat;

a fourth position in which the fourth portion engages the second stop, the pump is in the active condition, the bias of the means is overcome by water movement and the seal is positioned away from the seat;

a fifth position in which the third portion registers with the first stop, the pump is in the active condition, the bias of the means is overcome by water movement and the seal is positioned against the seat isolating the upstream chamber from the downstream chamber;

a sixth position in which the third portion engages the first stop and the second portion registers with the second stop, the pump is in the inactive condition and the means biases the seal away from the seat;

a seventh position in which the first and second portions engage the second stop and the fourth portion registers with the first stop, the pump is in the active condition, the bias of the means is overcome-by water movement and the seal is fixed away from the seat;

an eighth position in which the fourth portion engages the first stop and the first portion registers with the second stop, the pump is in the inactive condition and the means biases the seal away from the seat;

a ninth position in which the first portion engages the second stop, the pump is in the active condition, the bias of the means is overcome by water movement and the seal is positioned away from the seat; and a tenth position in which the second portion registers with the first stop, the pump is in the active condition, the bias of the means is overcome by water movement and the seal is positioned against the seat isolating the upstream chamber from the downstream chamber.

24. Apparatus of claim 23, wherein the means for biasing the piston comprises at least one compression spring having an end coupled to the piston and another end coupled to the housing.

25. Apparatus of claim 23, wherein the piston is mounted for reciprocal movement to an extension of the housing that depends from a removably attached lid.

26. Apparatus of claim 25, wherein the extension is reciprocally adjustable in opposition to the seat.

27. Apparatus of claim 26, further including an adjustment member for reciprocally adjusting the extension comprising an elongate element having a head secured to the lid for rotation and a threaded segment threadably associated with a complemental threaded segment of the extension.

28. Apparatus of claim 25, wherein the first and second stops are carried by the extension.

29. Apparatus of claim 23, wherein the seal comprises an annular body having an annular sealing surface which is capable of sealing against the seat.

30. Apparatus of claim 23, further including a relief valve assembly associated with the seal which is movable between a closed condition to an open condition for allowing water to pass from the first chamber to the second chamber when the pressure in the second chamber becomes insufficient to keep the relief valve assembly closed when the seal is sealed against the seat.

31. Apparatus of claim 30, wherein the relief valve assembly comprises:

openings extending through the seal;

a plate positioned against the seal closing the openings in a direction facing the second chamber; and means for biasing the plate against the seal.

32. Apparatus claim 31, wherein the means for biasing the plate comprises:

an element extending away from the seal toward the second chamber; and a compression spring captured between a head of the element and the plate.

* * * * *